US005325878A

United States Patent [19]

McKay

[11] Patent Number: 5,325,878

[45] Date of Patent: Jul. 5, 1994

[54] FLUID DISPENSING COMB

[76] Inventor: William D. McKay, 528 Kelso St., Flint, Mich. 48506

[21] Appl. No.: 932,890

[22] Filed: Aug. 19, 1992

Related U.S. Application Data

[63] Continuation-in-part of Ser. No. 917,854, Jul. 17, 1992.

[51] Int. Cl.[5] ..... A45D 24/22

[52] U.S. Cl. ..... 132/116; 132/108; 132/109; 132/110; 132/111

[58] Field of Search ..... 132/108, 112, 113, 114, 132/115, 116, 150, 110, 111

[56] References Cited

U.S. PATENT DOCUMENTS

| | | | |
|---|---|---|---|
| 85,311 | 12/1868 | Kerr, Jr. et al. | 132/113 |
| 792,124 | 6/1905 | Evans | 132/114 |
| 1,059,282 | 4/1913 | De Bassini . | |
| 1,408,262 | 2/1922 | Brueck et al. . | |
| 1,449,096 | 3/1923 | Grieten | 132/114 |
| 1,487,374 | 3/1924 | De Bassini | 132/108 |
| 1,794,130 | 2/1931 | Whalen | 132/111 |
| 1,823,850 | 5/1931 | Marshall . | |
| 1,829,021 | 10/1931 | Sinclair | 132/113 |
| 1,833,293 | 11/1931 | Laguionie | 132/111 |
| 1,851,859 | 3/1932 | Marshall | 132/110 |
| 1,876,033 | 9/1932 | Starr | 132/113 |
| 2,000,456 | 5/1935 | Schifter | 132/110 |
| 2,101,132 | 12/1937 | Daly et al. | 132/112 |
| 2,108,184 | 2/1938 | Wallenius | 132/116 |
| 2,148,966 | 3/1938 | Schmidt . | |
| 2,594,721 | 4/1952 | Beebe | 132/116 |
| 2,596,296 | 5/1952 | Shields . | |
| 2,608,976 | 9/1952 | Kittle et al. | 132/150 |
| 2,609,821 | 9/1952 | Weissberger | 132/116 |
| 2,699,173 | 1/1955 | Corel | 132/111 |
| 2,737,190 | 9/1951 | Magnusson . | |
| 2,794,443 | 6/1957 | Moore | 132/113 |
| 2,797,695 | 7/1957 | Fortmann | 132/110 |
| 3,147,757 | 9/1964 | Hofmann | 132/114 |
| 3,295,537 | 1/1967 | Young, Jr. | 132/113 |
| 3,429,642 | 2/1969 | Underwood | 132/116 |
| 3,446,216 | 4/1969 | Sala . | |
| 3,456,658 | 8/1969 | Long, Jr. . | |
| 3,463,170 | 8/1969 | McCullough | 132/113 |
| 3,520,311 | 7/1970 | Iesersek et al. | 132/116 |
| 3,683,942 | 8/1972 | McKay . | |
| 3,762,425 | 10/1973 | Loeffler | 132/110 |
| 3,818,917 | 6/1974 | Hudson | 132/116 |
| 3,908,679 | 9/1975 | Wright | 132/116 |
| 4,013,086 | 3/1977 | Chmela | 132/110 |
| 4,090,522 | 5/1978 | Donley et al. | 132/112 |
| 4,317,464 | 3/1982 | Bailey et al. | 132/113 |
| 4,585,018 | 3/1984 | O'Connor . | |
| 4,747,430 | 5/1988 | Alaimo . | |
| 4,792,250 | 12/1988 | Turner | 132/112 |

FOREIGN PATENT DOCUMENTS

| | | | |
|---|---|---|---|
| 0375856 | 7/1990 | European Pat. Off. | 401/269 |
| 7460 | of 1907 | United Kingdom | 132/114 |
| 13762 | of 1913 | United Kingdom | 132/111 |
| 299732 | 10/1928 | United Kingdom | 132/108 |
| 1265503 | 3/1972 | United Kingdom | 401/269 |

*Primary Examiner*—Gene Mancene
*Assistant Examiner*—Frank A. LaViola
*Attorney, Agent, or Firm*—Stetina and Brunda

[57] ABSTRACT

A fluid dispensing comb for applying a fluid to the hair has a body upon which a plurality of teeth are formed such that they are configured to have a V-shape, thereby defining a groove. An absorbent pad is disposed within the groove defined by the teeth and functions as a reservoir and application means for containing and dispensing a fluid such as hair oil, coloring, or conditioner to the hair. The absorbent pad is preferably replaceable and may be inserted into the groove of the teeth from the end of the comb, from the top of the comb, or alternatively by pivoting the teeth along a living hinge, formed at the apex or one end thereof. Alternatively, the absorbent pad may be permanently molded into the groove of the teeth. A cuff may optionally be disposed upon the comb to catch and/or absorb excess fluid which would otherwise tend to drip therefrom. Thus, the dispensing comb of the present invention provides a simple and convenient means for applying fluids to the hair whereby the user avoids directly contacting the fluid with the hands.

1 Claim, 2 Drawing Sheets

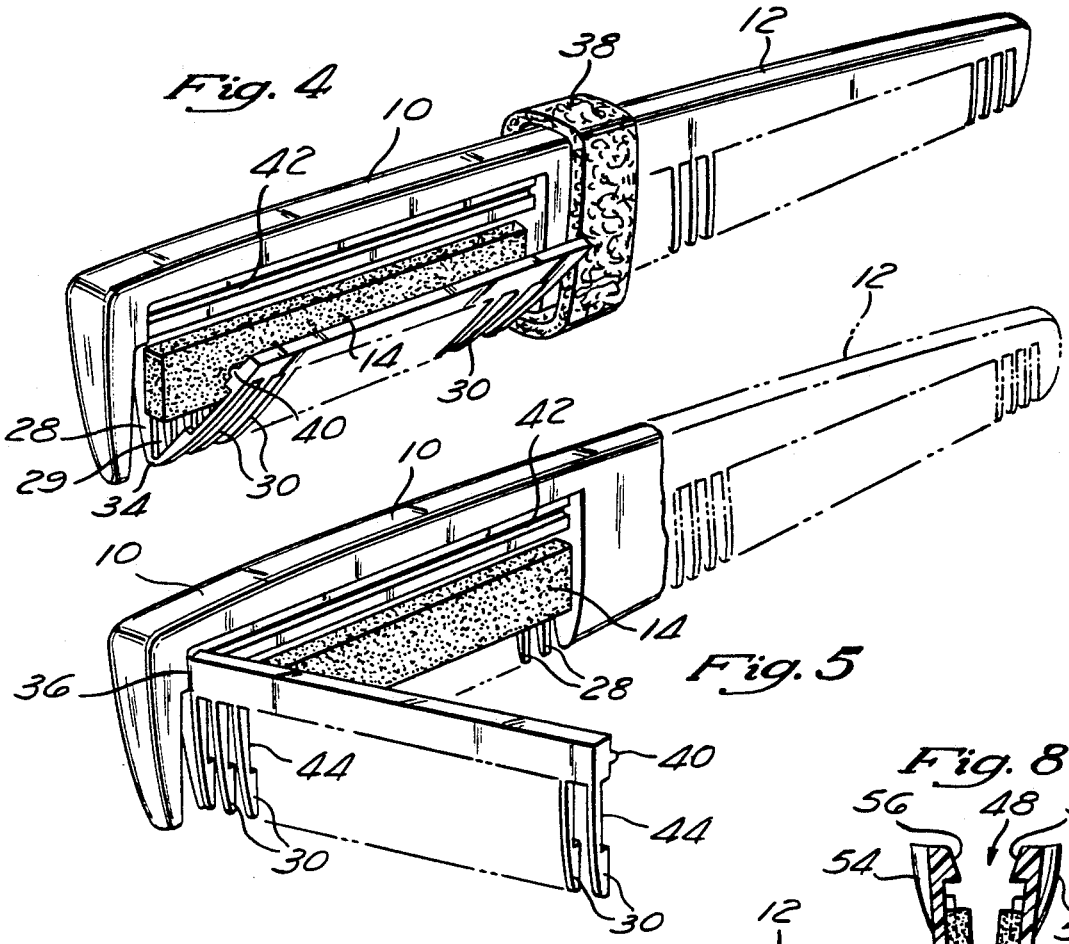
Fig. 4
12
38
10
42
14
30
28
40
29
34
30
12
42
10
10
14
36
28
Fig. 5
44
40
44
30
30
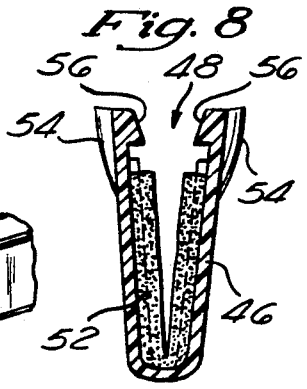
Fig. 8
56
48
56
54
54
46
52
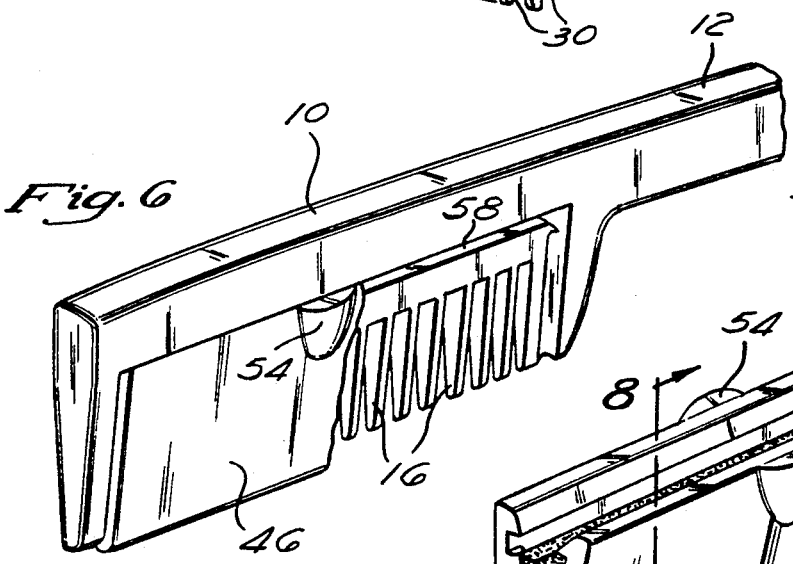
Fig. 6
12
10
58
54
16
46
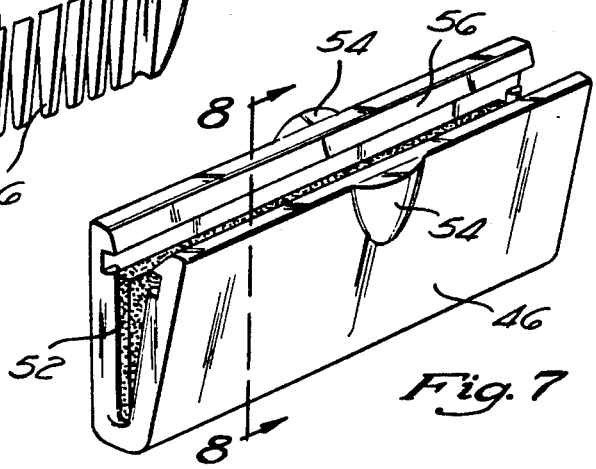
54
56
8
54
46
52
8
Fig. 7

FLUID DISPENSING COMB

RELATED APPLICATIONS

The subject patent application is a continuation-in-part application of copending U.S. Ser. No. 07/917,854, filed Jul. 17, 1992, pending and entitled FLUID DISPENSING COMB, the contents of which are hereby incorporated by reference.

FIELD OF THE INVENTION

The present invention relates generally to combs and more particularly to a fluid dispensing comb having an absorbent pad-type reservoir for storing and dispensing hair oil, conditioner, coloring, lightener, highlight, gloss, detangler, or the like directly upon a user's hair.

BACKGROUND OF THE INVENTION

Combs used for styling and grooming of the hair are well known. Such combs typically comprise a linear array of teeth which may be raked through the hair so as to position the hair in a desired manner. Various styles and configurations of combs are known.

Additionally, it is well known to apply various fluids, i.e., hair oil, conditioner, hair coloring, lightener, highlight, gloss, detangler, and the like, to the hair to promote its health and improve its appearance. Such fluids are typically applied by being dispensed from their container onto one's hair and then being manually dispersed through the hair with one's hands. Such manual dispersion of the fluid through one's hair inherently possesses substantial disadvantages. For instance, it generally requires that the user's hands come into intimate contact with the fluid. This is particularly undesirable in many instances wherein the fluid being dispersed may discolor or otherwise have an undesirable effect upon the skin and/or fingernails of the user's hands.

Furthermore, once a user's hands have come into contact with such a fluid, it is extremely difficult to avoid transferring the fluid to the user's clothing and/or other nearby objects. This is due to the frequency and habitual nature of utilizing one's hands in the performance of essentially all manual tasks.

For example, one may reach into one's pocket prior to remembering that one's hands have contacted the fluid, thus soiling one's clothing. This is particularly crucial in those instances where a fluid such as hair coloring is being applied to one's hair and has come into contact with one's hands. Such hair colorings may potentially discolor or stain clothing, towels, or other items or fabrics with which they come into contact.

A comb having an absorbent pad disposed within grooves formed in the teeth thereof for retaining and dispersing fluid throughout a user's hair is disclosed in U.S. Pat. No. 3,683,942, issued on Aug. 15, 1972, to Nicholas McKay, entitled CARTRIDGE COMB, the contents of which are hereby incorporated by reference. However, this comb suffers from the deficiency that it is comparatively difficult to remove and replace the absorbent pad within the comb.

Thus, although the prior art method of dispensing such fluids has proven generally suitable for its intended purpose, the process possesses inherent deficiencies which detract from its overall desirability and effectiveness. In view of the shortcomings of the prior art, it is therefore desirable to provide a means for dispensing such fluids which does not require the user to manually disperse the fluids throughout the hair utilizing the hands.

SUMMARY OF THE INVENTION

The present invention specifically addresses and alleviates the above mentioned deficiencies associated in the prior art. More particularly, the present invention comprises a fluid dispensing comb for applying a fluid to the hair. It has a body upon which a plurality of teeth are formed such that they are configured to have a V-shape, thereby defining a groove. An absorbent pad is disposed within the groove defined by the teeth. The absorbent pad functions as a reservoir and an application means for containing and dispensing a fluid such as hair oil, coloring, conditioner, lightener, highlight, gloss, detangler, or the like to the hair.

The absorbent pad is preferably replaceable and may be inserted into the groove of the teeth from the end of the comb, from the top of the comb, or alternatively by pivoting the teeth along a living hinge. The living hinge may be formed at either the apex of the teeth or at one end of the array of teeth. Alternatively, the absorbent pad may be permanently molded into the groove of the teeth.

A cuff may optionally be disposed upon the comb to catch and/or absorb excess fluid which would otherwise tend to drip therefrom and/or flow onto the comb's handle and/or the user's hand.

Thus, the dispensing comb of the present invention provides a simple and convenient means for applying fluids to the hair whereby the user avoids directly contacting the fluid with the hands. These, as well as other advantages of the present invention will be more apparent from the following description and drawings. It is understood that changes in the specific structure shown and described may be made within the scope of the claims without departing from the spirit of the invention.

BRIEF DESCRIPTION OF THE DRAWINGS

FIG. 4 is a perspective view of a fourth embodiment of the dispensing comb of the present invention wherein the teeth thereof are pivotally openable about a living hinge formed at the apex thereof;

FIG. 5 is a perspective view of a fifth embodiment of the dispensing comb of the present invention wherein the teeth are separable into first and second portions by pivoting about a living hinge formed at one end of the comb body;

FIG. 6 is a side elevational view, illustrating the use of an enclosure or cover for sealing fluid within the dispensing comb of the present invention;

FIG. 7 is a perspective view of the cover of FIG. 6; and

FIG. 8 is a cross-sectional side view of the cover of FIGS. 6 and 7.

DETAILED DESCRIPTION OF THE PREFERRED EMBODIMENT

The detailed description set forth below in connection with the appended drawings is intended as a description of the presently preferred embodiments of the invention and is not intended to represent the only forms in which the present invention may be constructed or utilized. The description sets forth the functions and sequence of steps for constructing and operating the invention in connection with the illustrated embodiments. It is to be understood, however, that the same or equivalent functions and sequences may be accomplished by different embodiments that are also intended to be encompassed within the spirit and scope of the invention.

Figure 1:
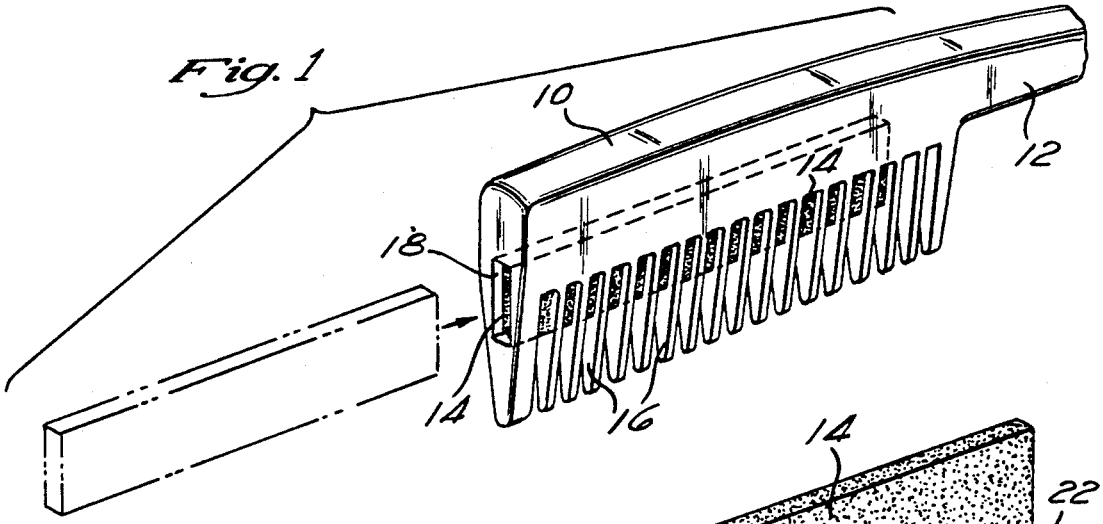
FIG. 1 is a perspective view of a first embodiment of the dispensing comb of the present invention wherein the absorbent material is inserted into the groove of the teeth from the end of the comb.

The fluid dispensing comb of the present invention is illustrated in FIGS. 1–8 which depict five presently preferred embodiments of the invention. Referring now to FIG. 1, a first embodiment of the present invention generally comprises a comb body 10 having a handle 12 formed at one end thereof and teeth 16 extending therefrom. A bore 18 extends horizontally through at least a portion of the body 10, and preferably through at least a portion of the teeth 16 such that an absorbent pad 14 inserted into the bore 18 will contact the hair during the combing process. The absorbent pad 14 is preferably comprised of a material such as felt, sponge, or a hydrophilic porous material such as POREX (a registered trademark of Porex Technologies, Fairburn, Ga.).

Figure 2:
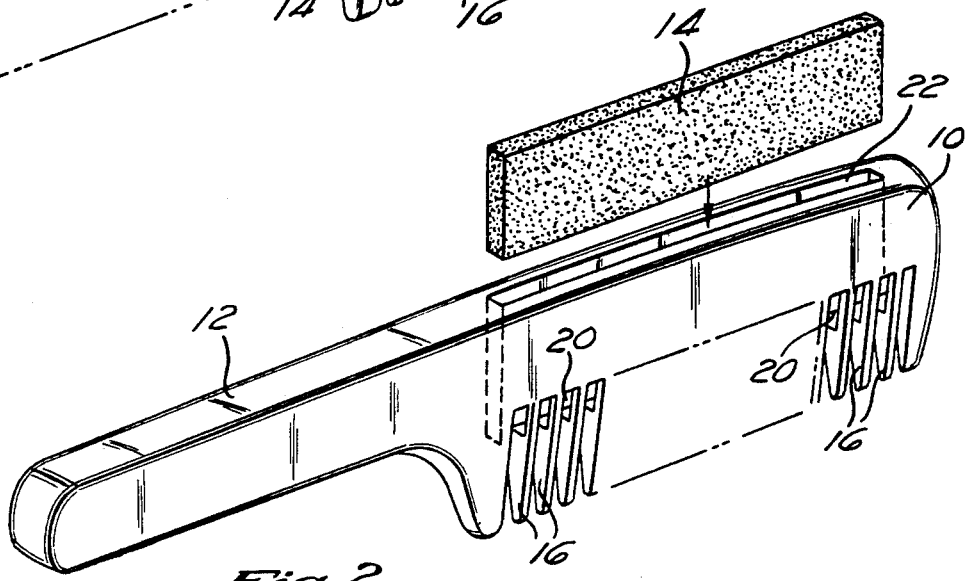
FIG. 2 is a perspective view of a second embodiment of the dispensing comb of the present invention wherein the absorbent pad is inserted into the groove of the teeth from the top of the comb.

Referring now to FIG. 2, a second embodiment of the fluid dispensing comb of the present invention comprises a comb body 10, a handle 12 formed at one end thereof, and teeth 16 extending therefrom, as in the first embodiment thereof. A bore 22 extends vertically through the upper surface of the comb body 10 and preferably into at least a portion of the teeth 16. As in the first embodiment of the fluid dispensing comb of the present invention, an absorbent pad 14 is positionable within the bore 22 such that it will contact the hair during the combing process.

Figure 3:
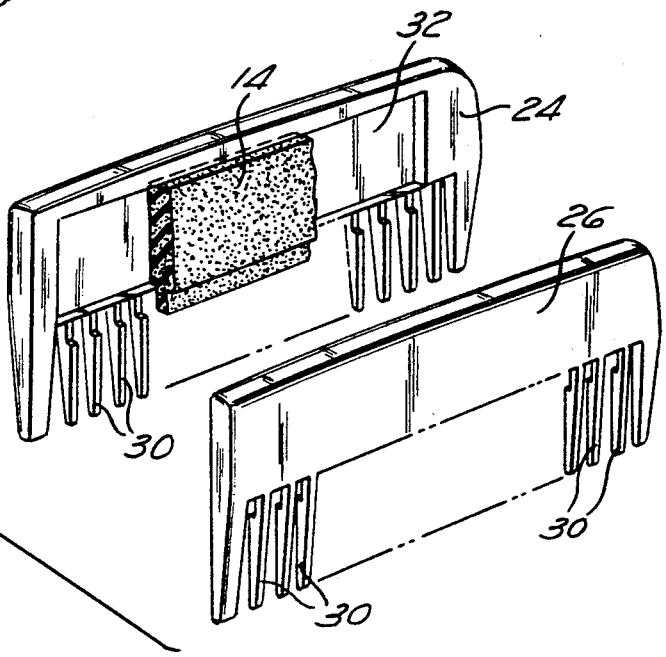
FIG. 3 is a exploded perspective view of a third embodiment of the dispensing comb of the present invention wherein the absorbent material is captured intermediate the two molded halves of the comb.

Referring now to FIG. 3, a third embodiment of the fluid dispensing comb of the present invention comprises first 24 and second 26 comb body halves, and teeth 30 extending therefrom. A void 32 is formed in the comb body halves 24 and 26 such that an absorbent pad 14 may be disposed therein and extend downward into at least a portion of the teeth 16 as in the first and second embodiments of the present invention. The first 24 and second 26 comb halves may be either permanently attached together or detachably attached together to facilitate replacement of the absorbent pad. The absorbent pad 14 may optionally be positioned in the void 32 during injection molding wherein the two halves 24, 26 are formed together as an integral unit. Alternatively, the absorbent pad 14 may be positioned within the void 32 after fabrication of the two halves 24 and 26. A handle (not shown) may optionally extend from the comb body comprised of comb body halves 24 and 26.

Referring now to FIG. 4, a fourth embodiment of the fluid dispensing comb of the present invention generally comprises a comb body 10 having a handle 12 formed at one end thereof. The handle 12 may optionally comprise a further comb body portion having teeth extending therefrom. Stationary teeth halves 28 extend from the comb body 10 and are attached via living hinge 34 to rotating teeth halves 30. A void 29 is formed intermediate stationary teeth halves 28 and rotating teeth halves 30 such that an absorbent material 14 may be positioned therein. The absorbent material 14 is positioned intermediate the stationary teeth halves 28 and the rotating teeth halves 30 such that it extends into at least a portion of the teeth halves 28 and 30, as in the first, second, and third embodiments of the present invention. Female detent 42 captures male detent 40 to lock the pad 14 within the comb body 10.

An absorbent collar 38 may optionally positioned intermediate the comb body 10 and the handle 12 to catch any excess fluid or drippings from the absorbent pad 14. The absorbent collar 38 may be utilized with any embodiment of the present invention as desired.

Referring now to FIG. 5, a fifth embodiment of the present invention generally comprises a comb body 10 and handle 12, as in the fourth embodiment of the fluid dispensing comb of the present invention. A living hinge 36 formed at the distal end of the comb body 10 connects rotating teeth 30 to stationary teeth 28 such that the rotating teeth 30 may be folded horizontally away from the vertical teeth 28 to expose void 44 formed in the teeth 30 and the comb body 10 into which an absorbent pad 14 may be disposed as in the fourth embodiment of the present invention. The living hinge may alternatively be formed at the proximal end of the comb body 10 and operate in an analogous fashion. Female detent 42 captures male detent 40 to lock the pad 14 within the comb body 10.

Referring now to FIGS. 6–8, a cover 46 may optionally be attached to the comb body 10 of any embodiment of the present invention such that the teeth 16 are completely enclosed thereby, thus capturing any excess fluid or drippings from the absorbent pad 14 therein. The optional cover 46 preferably comprises an absorbent lining 52 which will absorb any such excess fluid or drippings. A detent 56 formed along the upper surface of the cover 46 secures the cover 46 to the comb body 10 via a complimentary detent 58 formed in the comb body 10. Finger holds 54 facilitate easy removal of the cover 46 from the comb body 10. Those skilled in the art will recognize that various other means of securing the cover 46 to the comb body 10 are likewise suitable.

Having described the structure of the five embodiments of the fluid dispensing comb of the present invention, it may be beneficial to describe the operation thereof. First, an absorbent pad 14 is positioned within the comb body 10 by: sliding it through the distal end thereof in the first embodiment; sliding it down through the upper surface thereof in the second embodiment; separating the halves 24 and 26 of the comb body 10 if the pad is not pre-installed in the third embodiment; rotating the rotatable teeth 30 downward about the living hinge 34 in the fourth embodiment; or rotating the rotatable teeth 44 horizontally about the living hinge 36 in the fifth embodiment. Once the absorbent pad 14 is in position with the comb body 10, the rotatable teeth 30 or 44 in the fourth or fifth embodiment, respectively, are rotated back into their operative or locked position wherein the male detent 40 is captured within the female detent 42 and the absorbent pad 14 is thus securely captured within the comb body 10.

The absorbent pad 14 is then wetted with the desired fluid, hair oil, conditioner, hair coloring, lightener, highlight, gloss, and/or detangler or the like, and the comb is then used in the traditional manner to comb the hair. Such combing effects efficient transfer of the fluid from the absorbent pad 14 to the user's hair in a manner which avoids the necessity of having the fluid contact the user's hands.

Upon completion of the combing and fluid dispensing processes, the optional cover 46 may be attached to the comb body 10 such that further flow of fluid from the absorbent pad 14 is prevented. If used, the absorbent collar 38 may be removed and cleaned as required.

It is understood that the exemplary fluid dispensing comb described herein and shown in the drawings represents only presently preferred embodiments of the invention. Indeed, various modifications and additions may be made to such embodiments without departing from the spirit and scope of the invention. For example, the comb need not configured precisely as illustrated in the drawings, but rather those skilled in the art will recognize that various configurations, i.e. non-linearly configured teeth, various shapes and sizes, etc., are likewise suitable. Thus, these and other modifications and additions may be obvious to those skilled in the art may be implemented to adapt the present invention for use in a variety of different applications.

What is claimed is:

1. A fluid dispensing comb for applying fluid to the hair, said fluid dispensing comb comprising:

a) a body having a plurality of teeth formed thereon said teeth configured to have a V-shape and an apex, a groove being formed at least partially within said teeth;

b) an absorbent pad disposed within the groove defined by said teeth formed upon said body;

c) a hinge configured to allow said teeth to separate into first and second sides, the first sides of said teeth being attached to said body and the second sides of said teeth being detached from said body, such that said absorbent pad is removable and insertible into said groove by rotating said second sides of said teeth about said hinge; and d) an absorbent material positioned generally about the comb such that excess fluid is caught thereby to prevent dripping of the excess fluid, said absorbent material being configured as a cuff having a pocket into which said excess fluid is captured.

* * * * *